US006560795B2

(12) United States Patent
Hsia

(10) Patent No.: US 6,560,795 B2
(45) Date of Patent: May 13, 2003

(54) LIGHT WEIGHT SUPPORTING BOARD FOR PLAYYARD, PEN, COT, AND BED

(76) Inventor: Ben M. Hsia, 19401 Business Center Dr., Northridge, CA (US) 91324

( * ) Notice: Subject to any disclaimer, the term of this patent is extended or adjusted under 35 U.S.C. 154(b) by 0 days.

(21) Appl. No.: 09/905,601

(22) Filed: Jul. 13, 2001

(65) Prior Publication Data

US 2003/0009826 A1 Jan. 16, 2003

(51) Int. Cl.[7] ..... A47C 19/00

(52) U.S. Cl. ..... 5/186.1; 5/280; 5/724; 5/187

(58) Field of Search ..... 5/110–112, 131, 5/187, 280, 53.1, 724, 193, 186.1

(56) References Cited

U.S. PATENT DOCUMENTS 3,765,093 A * 10/1973 DeWoskin ..... 433/24
3,805,367 A * 4/1974 Hasty ..... 29/448
4,392,825 A * 7/1983 DeWoskin ..... 433/5
4,821,349 A * 4/1989 Cohen ..... 5/183
5,007,638 A * 4/1991 Yukl ..... 273/395
5,836,330 A * 11/1998 Franklin ..... 135/90
6,283,894 B1 * 9/2001 Steger ..... 482/27

* cited by examiner

*Primary Examiner*—Thomas B. Will
*Assistant Examiner*—Tara L. Mayo
(74) *Attorney, Agent, or Firm*—Raymond Y. Chen; David and Raymond Patent Group

(57) ABSTRACT

A light weight supporting board, which is adapted for incorporating with a playyard, pen, cot, and bed, includes a boundary frame, a supporting pocket and a retaining device. The supporting pocket includes a first layer having a tension surface and a second layer overlapped with the first layer to define a receiving cavity between the first layer and the second layer. The supporting pocket defines at least a U-shaped edge holder. The receiving cavity of the supporting pocket has a size and shape adapted for fittedly receiving the boundary frame. The retaining device is provided on the edge holder of the supporting pocket for securely enclosing the boundary frame in the edge holder and retaining a predetermined tension for the tension surface of the supporting pocket.

20 Claims, 8 Drawing Sheets

LIGHT WEIGHT SUPPORTING BOARD FOR PLAYYARD, PEN, COT, AND BED

BACKGROUND OF THE PRESENT INVENTION

1. Field of Invention

The present invention relates to the structures of supporting board, and more particularly to a light weight supporting board for playyard, pen, cot, and bed, which has a rigid, simple and strong structure to evenly distribute and support a downward force of a user's weight in lower cost.

2. Description of Related Arts

Referring to FIG. 1A, a boundary frame, such as playyard, pen, cot and bed, incorporated with a conventional supporting board is illustrated, wherein the supporting board is supported by the boundary frame. Usually, the supporting board is made of wood or is a cardboard that can support a user such as a young child thereon. However, the conventional supporting board has several drawbacks.

The supporting board is bulky and heavy for storage and transportation. In order to provide a rigid structure for supporting the user's weight, the supporting board must be constructed to have a high tension supporting surface. It is worth to mention that the tension supporting surface provides a predetermined tension force evenly distributed thereon, wherein when the downward force which is the user's weight is greater than the tension force, the supporting board will be cracked or even broken.

Especially for the playyard, the young child may jump on the supporting board. Since the supporting board is rigid but not flexible, the concentrated downward force exerted on the supporting board will easily crack the thereof. Therefore, the rigid supporting board may not be the best solution for the playyard or the like.

Some supporting boards made of cardboard having a lighter weight feature can be easily and quickly unfolded for use and fold into a compact unit for carriage. However, the fold-up structure of the supporting board cannot provide the high tension supporting surface. In other words, such supporting boards cannot rigidly support the user thereon.

Alternatively, the supporting board can be constructed by a plurality of parallel bars transversely supported on the boundary frame, as shown in FIG. 1B, such that a mattress can be rigidly supported on the supporting board.

Moreover, since the supporting board is made of wood which is one of the most valuable raw resources in the world, it is unreasonable to keep wasting the resource until it may be used up one day. So, an alternative is sought for.

SUMMARY OF THE PRESENT INVENTION

A main object of the present invention is to provide a light weight supporting board for playyard, pen, cot, and bed, which has a rigid, simple and strong structure to evenly distribute and support a downward force of a user's weight in lower cost.

Another object of the present invention is to provide a light weight supporting board for playyard, pen, cot, and bed, wherein the supporting board has a durable and elastic ability for providing a high tension supporting surface to enhance the durability of the supporting board.

Another object of the present invention is to provide a light weight supporting board for playyard, pen, cot, and bed, which provide a substantial support without altering or complicating the original structure of the playyard, pen, cot, and bed.

Another object of the present invention is to provide a light weight supporting board for playyard, pen, cot, and bed, wherein no expensive or mechanical structure is required to employ in the present invention in order to achieve the above mentioned objects. Therefore, the present invention successfully provides an economic and efficient solution for providing reinforced supporting configuration to the user supported on the playyard, pen, cot, and bed.

Accordingly, in order to accomplish the above objects, the present invention provides a light weight supporting board for playyard, pen, cot, and bed, which comprises:

- a supporting pocket comprising a first layer having a tension surface and a second layer overlapped with the first layer to define a receiving cavity between the first layer and the second layer;
- a boundary frame defining a central window and having a size and shape adapted to be fittedly received in the receiving cavity so as to mount the first layer covering the central window to form the tension surface; and
- means for retaining a predetermined tension on the tension surface of the supporting pocket, wherein the tension must be larger than a weight to be supported by the supporting board.

DETAILED DESCRIPTION OF THE PREFERRED EMBODIMENTS

Figure 1A:
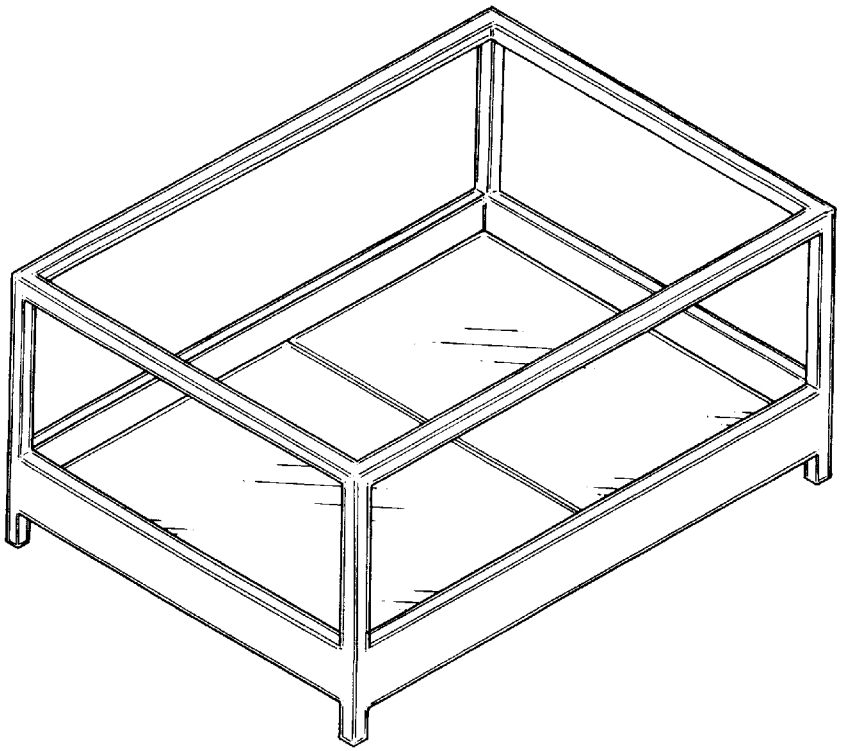
FIG. 1A PRIOR ART
FIG. 1A is a perspective view of a conventional supporting board for playyard, pen, and cot.
Figure 1B:
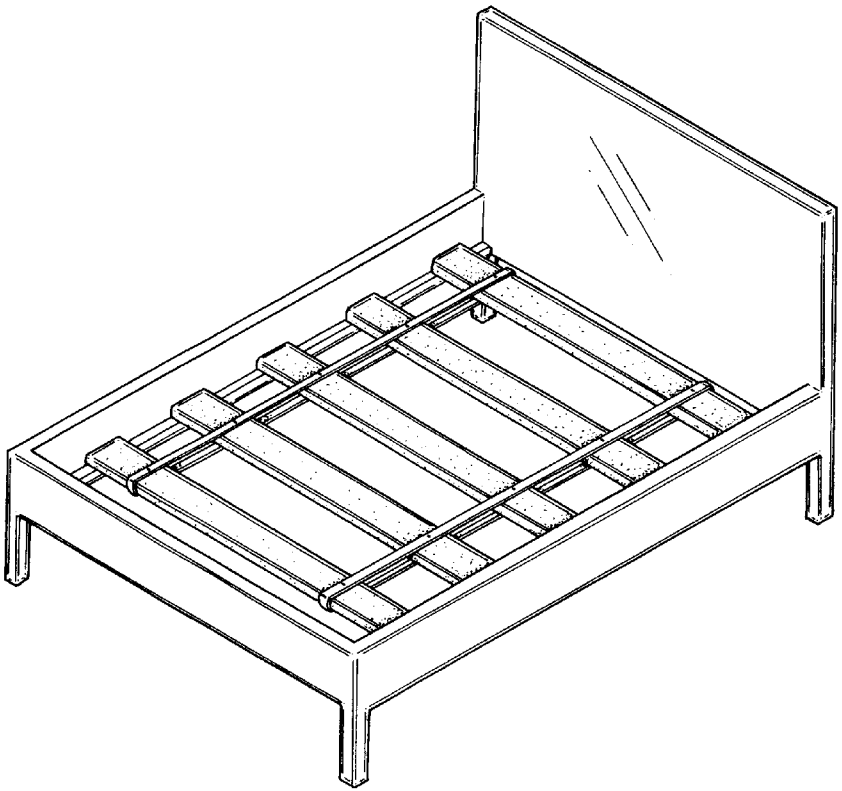
FIG. 1B PRIOR ART
FIG. 1B is a perspective view of a conventional supporting board for bed.
Figure 2A:
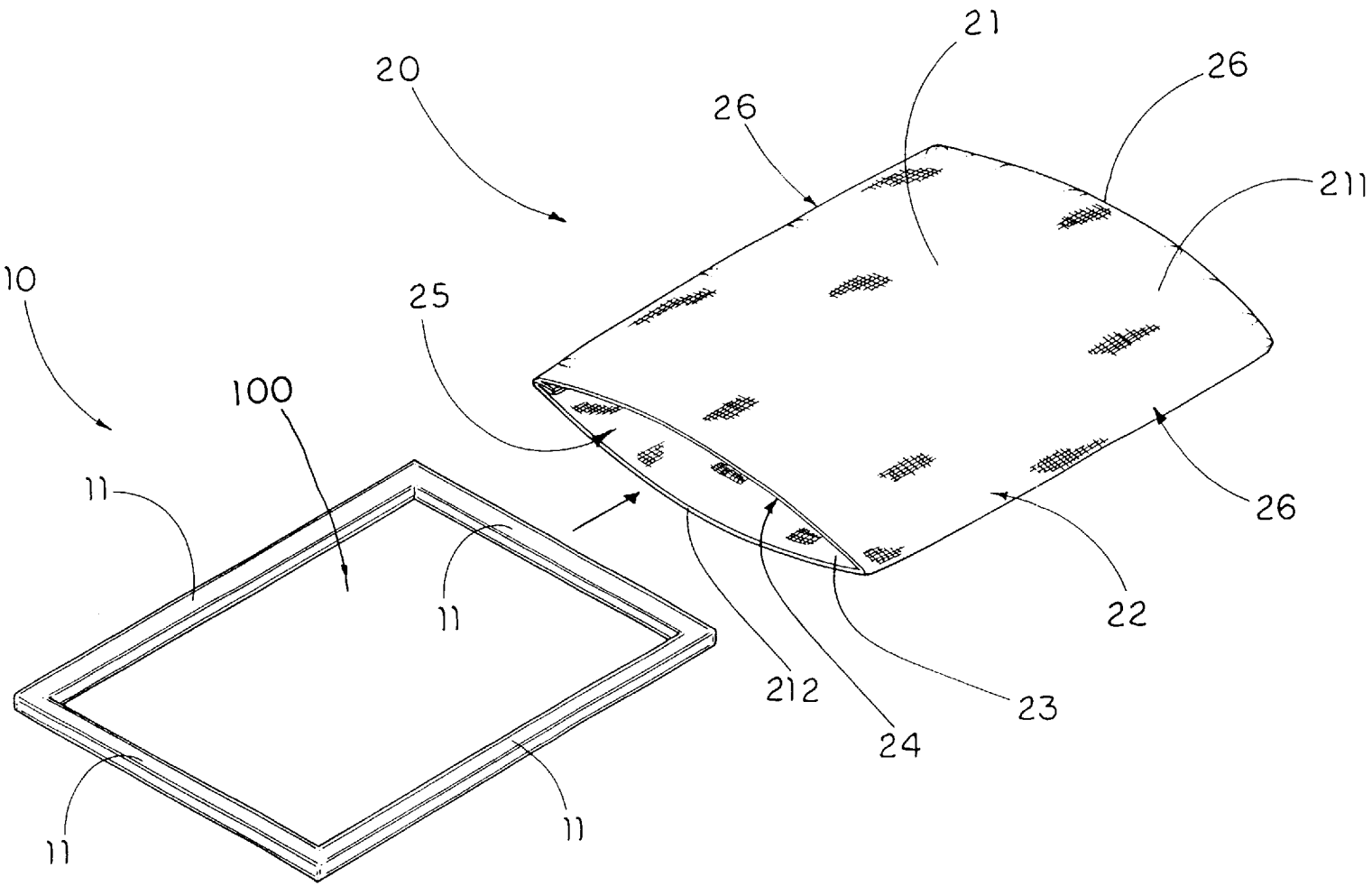
FIG. 2A is an exploded perspective view of a light weight supporting board for playyard, pen, cot, and bed according to a first preferred embodiment of the present invention.
Figure 2B:
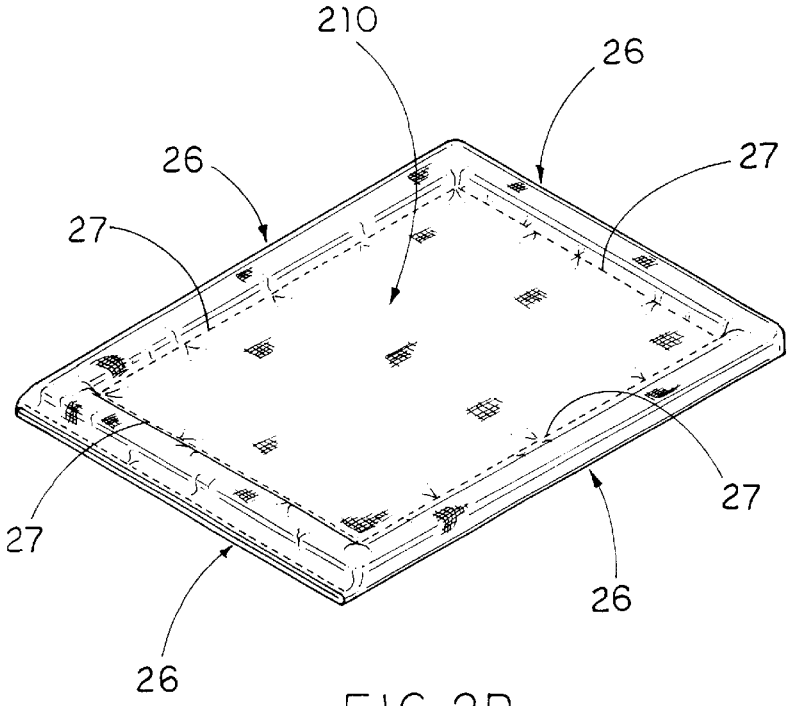
FIG. 2B is a perspective view of the light weight supporting board for playyard, pen, cot, and bed according to the above first preferred embodiment of the present invention.

Referring to FIGS. 2A and 2B of the drawings, a light weight supporting board 20 for playyard, pen, cot, and bed is illustrated, wherein as illustrated in the FIGS. 1A and 1B, the playyard, pen, cot, or bed comprises a frame for supporting the supporting board 20 thereon.

The supporting board 20 comprises a boundary frame 10, a supporting pocket 21, and a retaining means 27. The supporting pocket 21 comprises a first layer 22 having a tension surface 210 and a second layer 23 overlapped with the first layer 22 to define a receiving cavity 24 between the first layer 22 and the second layer 23.

The boundary frame 10 defines a central window 100 and has a size and shape adapted to be fittedly received in the receiving cavity 24 so as to mount the first layer 22 covering the central window 100 to form the tension surface 210. The retaining means 27 is arranged for retaining a predetermined tension on the tension surface 210 of the supporting pocket 21, wherein the tension must be larger than a weight to be supported by the supporting board 20.

Figure 3:
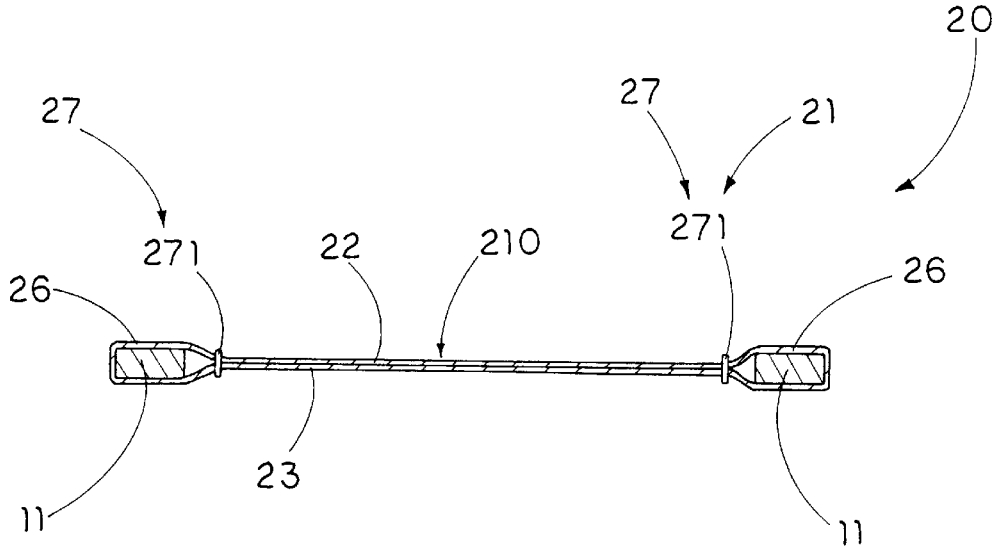
FIG. 3 is a sectional view of the light weight supporting board for playyard, pen, cot, and bed according to the above first preferred embodiment of the present invention.

According to the first preferred embodiment, as shown in FIGS. 2A, 2B and 3, the first layer 22 and the second layer 23 have the same rectangular size and overlappedly connected side to side together to define the receiving cavity 24 between the first layer 22 and the second layer 23. Three sides of the first layer 22 are integrally connected to three respective sides of the second layer 23 to define an opening 25 at a fourth side of both the first and second layers 22, 23.

The supporting pocket 21 further provides with at least an edge holder 26 having a U-shaped cross section, wherein the receiving cavity 24 of the supporting pocket 21 has a size and shape adapted for fittedly receiving the boundary frame 10 via the opening 25. The retaining means 27 is affixed on the edge holder 26 of the supporting pocket 21 for securely enclosing the boundary frame 10 in the edge holder 26, so as to enhance the tension surface 210 of the supporting pocket 21.

As shown in FIG. 2A, the boundary frame 10 comprises two pairs of parallel supporting arms 11 connected end to end to form a rectangular structure that also supports the supporting board 20 in a corresponding rectangular shape.

According to the preferred embodiment, the second layer 23 of the supporting pocket 21 is overlappedly extended from the first layer 22 thereof along a first longitudinal side 211 of the supporting pocket 21 so as to define the opening 25 along a second longitudinal side 212 of the supporting pocket 21.

The supporting pocket 21 is preferred to be made of lightweight and durable fabric material, such as mesh fabric or nylon, which is capable of evenly supporting a downward force of a user's weight exerted on the supporting pocket 21. The sheet material for making the web of a trampoline is also suitable for making the supporting pocket 21. Other elastic and durable sheet materials are fine too.

The supporting board 20 constructed with such supporting pocket 21 is preferred to be incorporated with the playyard, pen, or cot designed for a young child who has a weight up to 100 lbs. Of course, the more durable material is used to make the supporting pocket 21, the supporting board 20 of the present invention can support more weight, i.e. it may be incorporated with a bed for adult having 300 lbs by evenly distributing the adult's weight throughout the tension surface 210 while the supporting pocket 21 is well supported by the boundary frame 10.

It is worth to mention that if one pair of supporting arms 11 is foldable arms, i.e. there is a foldable joint constructed at a center portion of each of the pair of supporting arms 11, the supporting board 20 will has a foldable structure that enables the supporting board 20 to be folded up to half reduce its size to save space during storage and transportation.

The supporting pocket 21 can be formed by a piece of sheet folded in half along the first longitudinal side 211 to form the first and second layers 22, 23, such that the supporting pocket 21 has the corresponding shape and the second layer 23 is integrally extended from the first layer 22 overlappingly.

In order to form the receiving cavity 24, two ends of the first and second layers 22, 23 of the supporting pocket 21 must be sealed together to form two sealed ends for the supporting pocket 21. Technically, two ends of the first and second layers 22, 23 can be firmly attached with each other by stitching so that the receiving cavity 24 is defined between the first and second layers 22, 23 and the second longitudinal side 212 of the supporting pocket 21 is left opened to form the opening 25, as shown in FIG. 2A.

Alternatively, the first and second layers 22, 23 can certainly be sealed together at three edges thereof so as to form the receiving cavity 24 and define the opening 25 at the rest of the fourth edge of the first and second layers 22, 23.

As shown in FIGS. 2B and 3, the retaining means 27 comprises at least a retaining element 271 extended along the edge holder 26 for retaining the boundary frame 10 therein. According to the first preferred embodiment, the retaining element 271 is a stitching line extended the four sides of the supporting pocket 21 by sewed through the first and second layers 22, 23, wherein a surrounding tubular chamber is formed between the stitching line of the retaining element 271 and the four sides of the supporting pocket 21 to form the edge holder 26, so that the four supporting arms 11 of the boundary frame 10 is enclosed and retained inside the surrounding tubular chamber of the edge holder 26. In other words, boundary frame 10 is received in the edge holder 26 and the retaining element 271 is stitched along the edge holder 26 to enclose the supporting arm 11 of the boundary frame 10 therein.

Referring to FIG. 3, when the retaining element 271 of the retaining means 27 is provided on the edge holder 26 of the supporting pocket 21, the tension surface 210 of the supporting pocket 21 will be stretched aside in order to increase the tension of the supporting pocket 21 within the tension surface 210 thereof. Moreover, the retaining element 271 of the retaining means 27 can also retain the supporting pocket 21 on the boundary frame 10 in position.

In other words, according to the first preferred embodiment, the retaining element 271, i.e. the surrounding stitching line, not only retains the boundary frame 10 in position inside the supporting pocket 21, but also substantially retains a predetermined tension on the tension surface 210 of the supporting surface 21. It is because the size of the supporting pocket 21 should be made to fittedly receive the boundary frame 10 therein. After the boundary frame 10 is inserted into the receiving cavity 24 of the supporting pocket 21, there is still a space defined between the first layer 22 and the second layer 23, wherein the thickness of such space is equal to the thickness of the boundary frame 10. Then, on the supporting pocket 21, the manufacturer can sew the stitching line 271 along the inner side of the four supporting arms 11 of the boundary frame 10. As shown in FIG. 3, the stitching line 271 substantially sews the first and second layers 22, 23 together that the inner surface of the first layer 22 are pulled to contact with the inner surface of the second layer 23. In other words, the first and second layers 22, 23 are pushed towards each other so as to substantially increase the surface tension of the first and second layers 22, 23. The surface area of the first layer 22 encircled by the stitching line 271 forms the tension surface 210. In other words, the tension of the tension surface 210 is retained and the second layer 23 also reinforces the first layer 22 by doubling the thickness of the tension surface 210.

Figure 4:
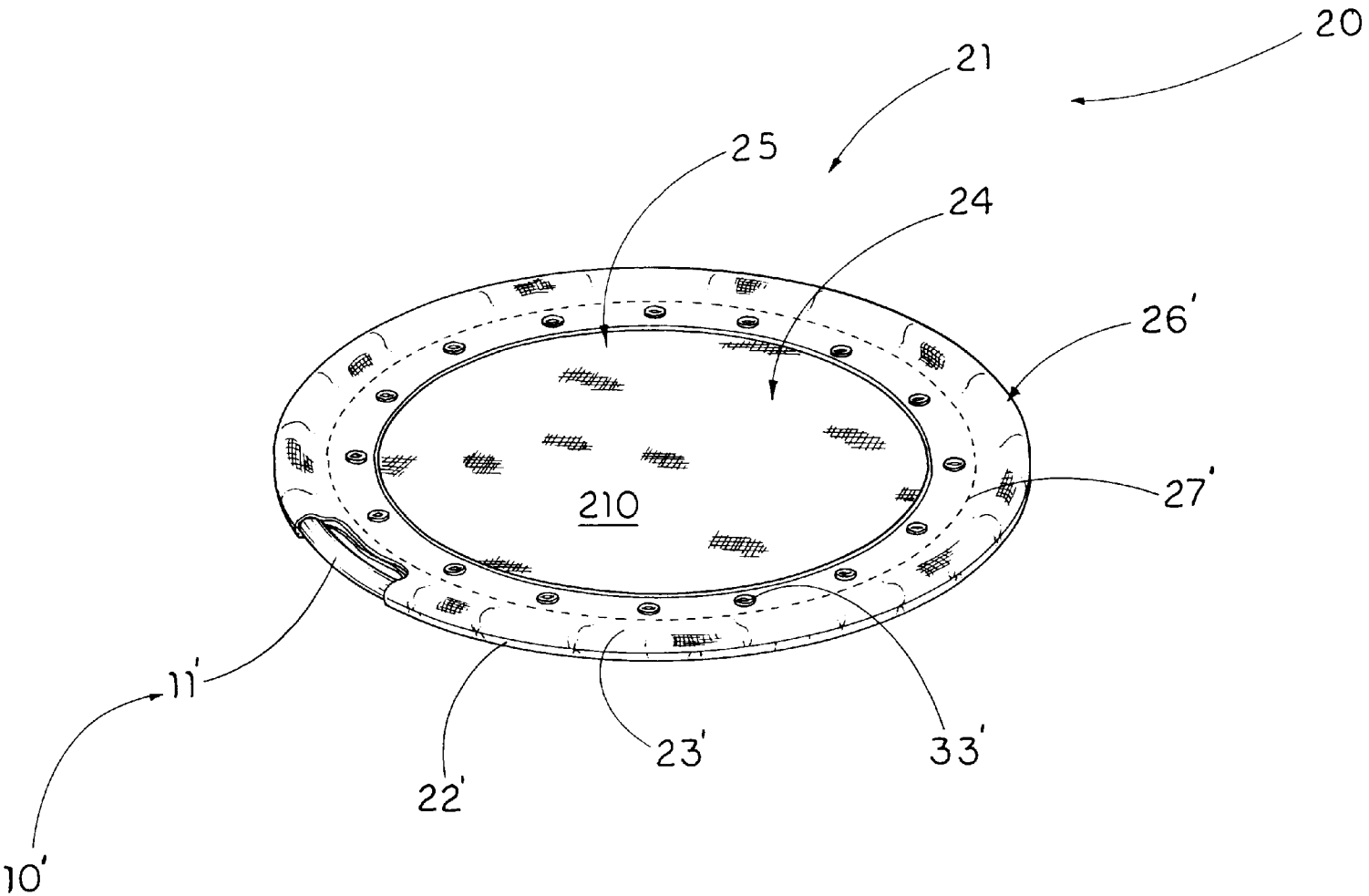
FIG. 4 is a perspective view of a light weight supporting board for playyard, pen, cot, and bed according to a second preferred embodiment of the present invention.
Figure 7:
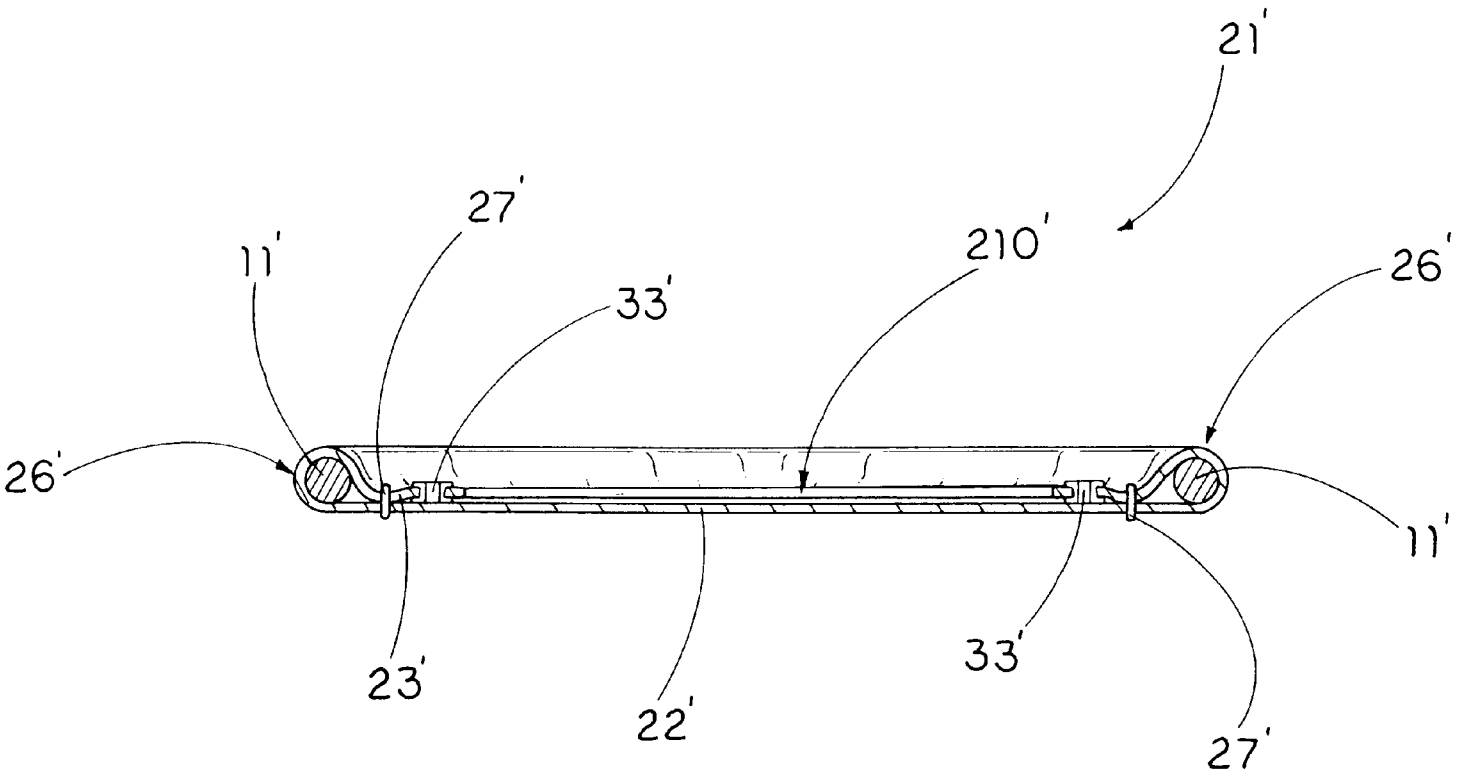
FIG. 7 is a sectional view of the light weight supporting board for playyard, pen, cot, and bed according to the above second preferred embodiment of the present invention.

Referring to FIGS. 4 and 7, a second embodiment of the supporting board 20' is illustrated, which is an alternative mode of the first embodiment of the present invention. The first alternative mode to be illustrated is that the boundary frame 10' comprises a circular supporting arm 11' and the supporting pocket 20' is also formed in a corresponding circular size and shape that is fittedly supported by the boundary frame 10'.

The second alternative mode to be illustrated is that the second layer 23' of the supporting pocket 21' is made in ring shape that is merely overlappedly extended around an outer portion of the first layer 22'. As shown in FIGS. 4 and 7, the second layer 23' is formed by folding an outer edge of the first layer 22' to the bottom surface thereof overlappedly, wherein an opening 25' is coaxially provided on a central portion of the second layer 212'. Alternatively, the second layer 23' can be an independent piece that the outer circumferential edges of the first and second layers 22', 23' are integrally connected together in an edge to edge manner by sewing (for example).

In order to form the receiving cavity 24' to receive the boundary frame 10', an inner circumferential edge of the second layer 23' is attached to the first layer 22' of the supporting pocket 21'. Technically, the first and second layers 22', 23' can be firmly attached with each other by stitching so that a ring-shaped pocket is defined between the outer circumferential portion of the first layer 22' and the ring shape second layer 23' to form the receiving cavity 24', as shown in FIG. 4, wherein the overlapped second layer 23' and the outer circumferential portion of the first layer 22' forms the edge holder 26' to hold the boundary frame 10' in position, as shown in FIG. 7.

The stitching line, which is extended around the inner circumferential edge of the second layer 23' for attaching the second layer 23' with the first layer 22', substantially forms the retaining element 271' of a retaining means 27', which functions similarly to the stitching line 271 of the above first preferred embodiment for retaining a predetermined tension of the tension surface 210', which is the central portion of the first layer 22' mounted on the boundary frame 10'.

Figure 5:
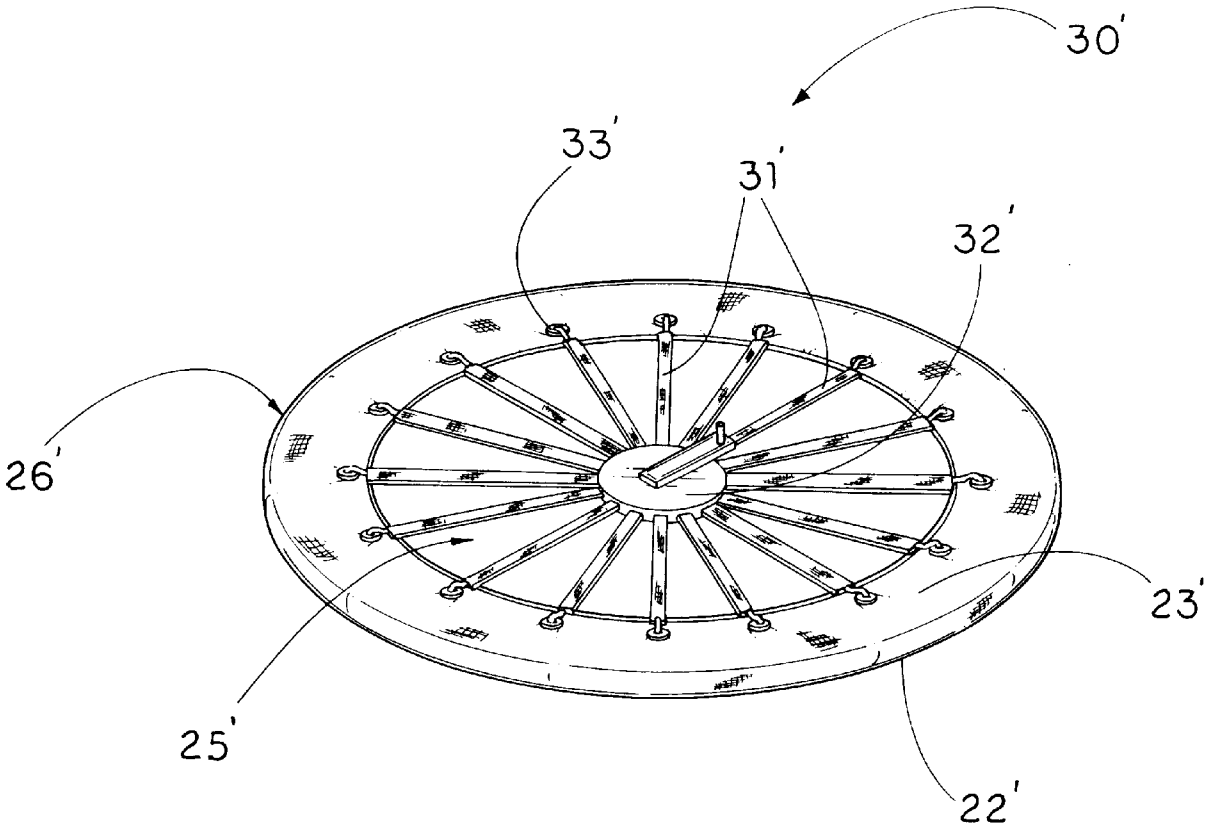
FIG. 5 is a perspective view of a stretching apparatus of the light weight supporting board for playyard, pen, cot, and bed according to the above second preferred embodiment of the present invention.

In order to stitch the second layer 23' to the first layer 22', the present invention is preferred to employ with a stretching apparatus 30' for ensuring the tension evenly distributed on the tension surface 210' of the supporting pocket 21' during the stitching operation, as shown in FIG. 5.

Figure 6:
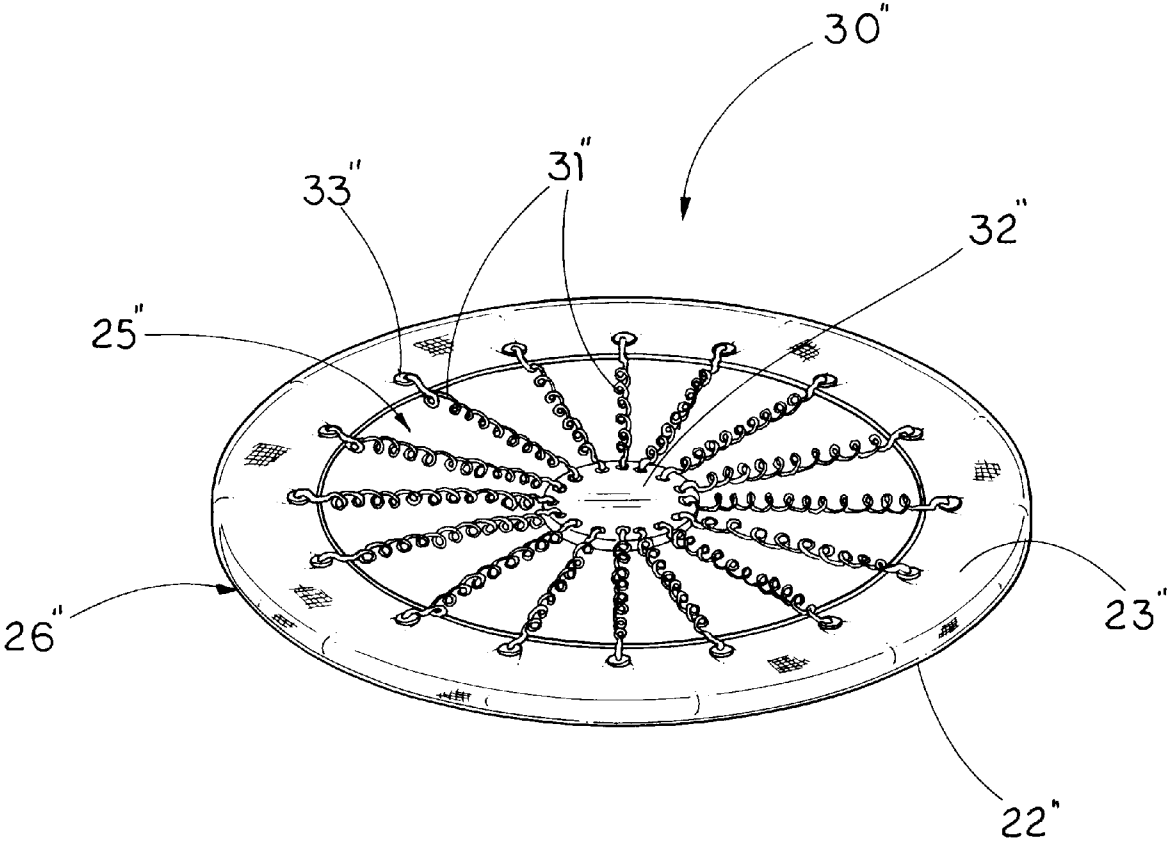
FIG. 6 illustrates an alternative mode of a stretching apparatus of the light weight supporting board for playyard, pen, cot, and bed according to the above second preferred embodiment of the present invention.

The stretching apparatus 30' comprises a plurality of durable pulling straps 31' each having an attaching end detachably attached to the inner edge of the second layer 23' and a connecting end affixed to a pulling device 32'. The pulling device 32' is arranged to pull the puling straps 31' for reducing a size of the opening 25' of the supporting pocket 21', so as to stretch the first layer 22' of the supporting pocket 21' to increase the tension thereof. Then, we merely need to sew the stitching line around the inner edge of the second layer 23' to connect the first and second layers 22', 23' and to form the retaining element 271' to enclose and retain the supporting arm 11' of the boundary frame 10' inside the receiving cavity 25', as shown in FIG. 6.

The stretching apparatus 30' further comprises a plurality of protective rings 33' spacedly formed on the inner circumferential edge of the second layer 23' for the pulling device 32' detachably attaching thereto, so as to prevent the supporting pocket 21' being torn while pulling the puling straps 32'.

As shown in FIG. 5, the pulling straps 31' are radially extended from the pulling device 32' in such a manner that the pulling straps 31' are pulled towards to the pulling device 32' at the same time in order to stretch the supporting pocket 21' evenly. It is worth to mention that the tension force distributed on the tension surface 210' of the supporting pocket 21' can be determined by the stretching apparatus 30', as shown in FIG. 5. In other words, the tension force of the supporting pocket 21' can be determined by the pulling force applied by the pulling device 32' to stretch the supporting pocket 21' through the pulling straps 31'. After the retaining means 27' is attached on the supporting pocket 21', the stretching apparatus 30' can be detached from the supporting pocket 21' since the supporting pocket 21' is firmly attached on the boundary frame 10' already.

Alternatively, the stretching apparatus 30" can be a spring device for providing an urging force to stretch the supporting pocket 21" wherein a plurality of compression springs 31" is used to substitute the pulling straps 31'. Each of the compression springs 31" has one end radially connected to the puling device 32" and another end detachably connected to the inner circumferential edge of the second layer 23" of the supporting pocket 21". The tension force of the supporting pocket 21" can be determined by the spring force of the compression spring 31". Therefore, the tension of the supporting pocket 21" can be calculated to fit the need of the user, such as providing a larger tension force of the supporting board 20" when it is used on the bed frame for adults or a smaller tension force of the supporting board 20" when it is used on the playyard, cot, or pen for young kids.

It is worth to mention that when the boundary frame 10' of the second embodiment is constructed to form a rectangular structure, the stretching apparatus 30' is adapted for pulling the two opposed opening edges of the receiving cavity 24' towards each other so as to reduce the size of the opening 25' and stretch the supporting pocket 21'. Thus, when the supporting board 20' is incorporated with the playyard, pen, or cot for a young child, the supporting boards 20' can be functioned as a trampoline for the young child playing thereon. When a mattress is placed on the supporting board 20', the boundary frame 10' can be functioned as a bed frame for the young child lying thereon.

What is claimed is:

1. A light weight supporting board for playyard, pen, cot, and bed, comprising:

a supporting pocket comprising a first layer having a tension surface and a second layer overlapped with said first layer to define a receiving cavity between said first layer and said second layer, wherein said supporting pocket provides with at least an edge holder having a U-shaped cross section;

a boundary frame defining a central window and having a size and shape adapted to be fittedly received in said receiving cavity so as to mount said first layer covering said central window to form said tension surface; and at least a retaining element affixed and extended along said at least one edge holder of said supporting pocket for securely enclosing said boundary frame in said at least one edge holder, wherein said retaining element comprises a stitching line extended along said at least one edge holder of said supporting pocket by sewing through said first and second layers to define a surrounding tubular chamber for said at least one edge holder to enclose and retain said boundary frame inside said surrounding tubular chamber of said at least one edge holder and enhance said tension surface of said supporting pocket.

2. The supporting board, as recited in claim 1, wherein said boundary frame comprises two pairs of parallel supporting arms connected end to end to form a rectangular structure that also supports said supporting board in a corresponding rectangular shape.

3. The supporting board, as recited in claim 2, wherein said first layer and said second layer are overlappedly connected side to side together integrally to define said receiving cavity between said first layer and said second layer, wherein three sides of said first layer are integrally connected to three respective sides of said second layer to define an opening at a fourth side of both said first and second layers, wherein after said boundary frame is placed inside said receiving cavity through said opening, said opening is sealed by connecting said fourth sides of said first and second layers together.

4. The supporting board, as recited in claim 3, wherein said second layer of said supporting pocket is overlappedly extended from said first layer thereof along a first longitudinal side of said supporting pocket so as to define said opening along a second longitudinal side of said supporting pocket.

5. The supporting board, as recited in claim 4, wherein said stitching line is extended along four sides of said supporting pocket by sewing through said first and second layers, wherein said surrounding tubular chamber of said at least one edge holder is formed between said retaining element and said four sides of said supporting pocket, so that said four supporting arms of said boundary frame are enclosed and retained inside said surrounding tubular chamber of said at least one edge holder, wherein said retaining element substantially stitches said first and second layers together and a surface area surrounding by said retaining element on said first layer is defined as said tension surface, wherein an inner surface of said first layer is pulled to contact with an inner surface of said second layer and thus said first and second layers are pushed towards each other so as to substantially increase said surface tension of said first layer.

6. The supporting board, as recited in claim 3, wherein said stitching line is extended along four sides of said supporting pocket by sewing through said first and second layers, wherein said surrounding tubular chamber of said at least one edge holder is formed between said retaining element and said four sides of said supporting pocket, so that said four supporting arms of said boundary frame are enclosed and retained inside said surrounding tubular chamber of said at least one edge holder, wherein said retaining element substantially stitches said first and second layers together and a surface area surrounding by said retaining element on said first layer is defined as said tension surface, wherein an inner surface of said first layer is pulled to contact with an inner surface of said second layer and thus said first and second layers are pushed towards each other so as to substantially increase said surface tension of said first layer.

7. The supporting board, as recited in claim 1, wherein said boundary frame comprises a circular supporting arm and said supporting pocket is formed in a corresponding circular size and shape that is fittedly supported by said boundary frame.

8. The supporting board, as recited in claim 7, wherein said second layer is formed by folding an outer edge of said first layer to a bottom surface thereof overlappedly.

9. The supporting board, as recited in claim 7, wherein said second layer of said supporting pocket is made in a ring shape that is overlappedly extended around an outer portion of said first layer, wherein an opening is coaxially provided on a central portion of said second layer.

10. The supporting board, as recited in claim 9, wherein an inner circumferential edge of said second layer is attached to said first layer of said supporting pocket so as to form a ring-shaped pocket between an outer circumferential portion of said first layer and said ring shape second layer to form said receiving cavity, and that said second layer and said outer circumferential portion of said first layer forms said at least one edge holder to hold said boundary frame in position.

11. The supporting board, as recited in claim 10, wherein said retaining element is a stitching line sewing said first and second layers together and extended around said inner circumferential edge of said second layer for retaining said predetermined tension of said tension surface which is a central portion of said first layer mounted on said boundary frame.

12. The supporting board, as recited in claim 11, further comprising a stretching apparatus for ensuring said tension evenly distributed on said tension surface of said supporting pocket when stitching said retaining element, wherein said stretching apparatus comprises a plurality of durable pulling straps each having an attaching end detachably attached to said inner circumferential edge of said second layer and a connecting end affixed to a pulling device, wherein said pulling device is arranged to pull said pulling straps for reducing a size of said opening of said supporting pocket, so as to stretch said first layer of said supporting pocket to increase said tension thereof.

13. The supporting board, as recited in claim 12, wherein said stretching apparatus further comprises a plurality of protective rings spacedly formed on said inner circumferential edge of said second layer, wherein said attaching ends of said pulling straps of said pulling device are capable of detachably attaching thereto respectively.

14. The supporting board, as recited in claim 11, further comprising a stretching apparatus comprises a spring device for providing an urging force to stretch said supporting pocket when stitching said retaining element, wherein said spring device comprises a plurality of compression springs each having one end radially connected to a pulling device and another end detachably connected to said inner circumferential edge of said second layer of said supporting pocket.

15. The supporting board, as recited in claim 1, wherein said second layer of said supporting pocket is made in a ring shape that is overlappedly extended around an outer portion of said first layer, wherein an opening is coaxially provided on a central portion of said second layer.

16. The supporting board, as recited in claim 15, wherein an inner circumferential edge of said second layer is attached to said first layer of said supporting pocket so as to form a ring-shaped pocket between an outer circumferential portion of said first layer and said ring shape second layer to form said receiving cavity, and that said second layer and said outer circumferential portion of said first layer forms said at least one edge holder to hold said boundary frame in position.

17. The supporting board, as recited in claim 16, wherein said retaining element is a stitching line sewing said first and second layers together and extended around said inner circumferential edge of said second layer for retaining said predetermined tension of said tension surface which is a central portion of said first layer mounted on said boundary frame.

18. The supporting board, as recited in claim 17, further comprising a stretching apparatus for ensuring said tension evenly distributed on said tension surface of said supporting pocket when stitching said retaining element, wherein said stretching apparatus comprises a plurality of durable pulling straps each having an attaching end detachably attached to said inner circumferential edge of said second layer and a connecting end affixed to a pulling device, wherein said pulling device is arranged to pull said pulling straps for reducing a size of said opening of said supporting pocket, so as to stretch said first layer of said supporting pocket to increase said tension thereof.

19. The supporting board, as recited in claim 18, wherein said stretching apparatus further comprises a plurality of protective rings spacedly formed on said inner circumferential edge of said second layer, wherein said attaching ends of said pulling straps of said pulling device are capable of detachably attaching thereto respectively.

20. The supporting board, as recited in claim 17, further comprising a stretching apparatus comprises a spring device for providing an urging force to stretch said supporting pocket when stitching said retaining element, wherein said spring device comprises a plurality of compression springs each having one end radially connected to a pulling device and another end detachably connected to said inner circumferential edge of said second layer of said supporting pocket.

* * * * *